US011713563B2

(12) United States Patent
Tzeng

(10) Patent No.: US 11,713,563 B2
(45) Date of Patent: Aug. 1, 2023

(54) NEAR-END SENSING ELECTRONIC FAUCET

(71) Applicant: Ncip Inc., Taipei (TW)

(72) Inventor: Rong-Chyan Tzeng, Taipei (TW)

(73) Assignee: NCIP INC., Taipei (TW)

( * ) Notice: Subject to any disclaimer, the term of this patent is extended or adjusted under 35 U.S.C. 154(b) by 167 days.

(21) Appl. No.: 17/393,799

(22) Filed: Aug. 4, 2021

(65) Prior Publication Data

US 2022/0098839 A1 Mar. 31, 2022

(30) Foreign Application Priority Data

Sep. 30, 2020 (TW) ..... 109212950

(51) Int. Cl.
*E03C 1/04* (2006.01)
*E03C 1/02* (2006.01)

(52) U.S. Cl.
CPC ..... *E03C 1/0404* (2013.01); *E03C 2001/026* (2013.01)

(58) Field of Classification Search
CPC ..... E03C 1/0404
USPC ..... 4/676–678
See application file for complete search history.

(56) References Cited

U.S. PATENT DOCUMENTS 8,572,772 B2 * 11/2013 Wolf ..... E03C 1/057 4/678
2001/0011390 A1 * 8/2001 Humpert ..... E03C 1/05 4/677
2007/0022529 A1 * 2/2007 Thorne ..... E03C 1/0404 4/678
2011/0284111 A1 * 11/2011 Marty ..... E03C 1/0404 137/613
2013/0340162 A1 * 12/2013 Peel ..... E03C 1/055 4/676
2015/0033469 A1 * 2/2015 Ferrante ..... E03C 1/057 4/678
2015/0292187 A1 * 10/2015 Tseng ..... E03C 1/0412 4/677
2022/0034075 A1 * 2/2022 Tzeng ..... E03C 1/057

* cited by examiner

*Primary Examiner* — Lori L Baker
(74) *Attorney, Agent, or Firm* — Muncy, Geissler, Olds & Lowe, P C.

(57) ABSTRACT

A near-end sensing electronic faucet comprises a manual mixing valve, an electronic switch valve switching between an on state and an off state, a spout fluidly connected to the electronic switch valve, and an electronic module. The manual mixing valve comprises a valve body fluidly connected to a cold water source and a hot water source and outputting a mixed water, and an adjusting lever operated to adjust flow of the cold water source and the hot water source to change a water temperature of the mixed water. The electronic module comprises a proximity sensor and a controller electrically connected to the proximity sensor which is provided and exposed on a top surface of the near-end sensing electronic faucet, the proximity sensor includes an activated state and an inactivated state, and the controller controls movement of the electronic switch valve.

9 Claims, 8 Drawing Sheets

NEAR-END SENSING ELECTRONIC FAUCET

FIELD OF THE INVENTION

The invention relates a faucet, and more particularly to a near-end sensing electronic faucet.

BACKGROUND OF THE INVENTION

Faucet is a device used to control the flow of water. After a faucet is disposed with a water control valve and connected to a cold water source and a hot water source, temperature and flow rate of the output water can be changed by regulating the water control valve.

However, by regulating the water control valve to control the faucet, there will be problems of bacterial contact or recontamination, and with the gradual improvement of people's quality of life, more and more attention is paid to the convenience and diversity of water use. Therefore, how to improve the function and practicability of the faucet is indeed the focus of attention of relevant personnel in the field.

SUMMARY OF THE INVENTION

The invention provides a near-end sensing electronic faucet capable of improving the convenience of use and installation, reducing costs and reducing installation procedures.

Other objects and advantages of the invention can be further understood from the technical features disclosed in the invention.

The near-end sensing electronic faucet of the invention comprises a water outlet faucet, a manual mixing valve, a water way assembly, an electronic switch valve and an electronic module.

The water outlet faucet comprises a mounting section extending along an upright axis and an extending section extending forwardly from a top of the mounting section. The mounting section comprises a first space and a bottom opening communicating with the first space. The extending section comprises a second space communicating with the first space, and a spout.

The manual mixing valve is received in the first space of the mounting section, and comprises a valve body, a valve chamber received in the valve body, and an adjusting lever coupled to the valve body. The valve chamber comprises a first lower inlet connected to a cold water source, a second lower inlet connected to a hot water source, and an upper outlet outputting a mixed water. The adjusting lever can be manipulated to adjust flow of the cold water source and the hot water source entering the valve chamber to change a water temperature of the mixed water.

The water way assembly is received in the first space of the mounting section and provided on the manual mixing valve. The water way assembly comprises a first annular chamber communicating with the upper outlet, a second annular chamber provided above the first annular chamber and communicating with the first annular chamber, a transverse fluid channel provided between the first annular chamber and the second annular chamber, at least one first upright fluid channel communicating between the first annular chamber and the second annular chamber, and a second upright fluid channel communicating between the second annular chamber and the transverse fluid channel. The transverse fluid channel includes an opening away from the second upright fluid channel and communicating with the spout.

The electronic switch valve is received in the first space of the mounting section and provided above the water way assembly. The electronic switch valve comprises a sealing member provided between the second annular chamber and the second upright fluid channel. The sealing member is movable between a release position and a retention position.

The electronic module comprises a proximity sensor and a controller. The controller is received in the second space of the extending section and electrically connected to the proximity sensor. The proximity sensor is provided and partially exposed on a top surface of the extending section to detect a presence of a nearby object such that the controller controls the electronic switch valve according to detection of the proximity sensor.

DETAILED DESCRIPTION OF THE PREFERRED EMBODIMENTS

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details.

The terminology used in the description of the various described embodiments herein is for the purpose of describing particular embodiments only and is not intended to be limiting. As used in the description of the various described embodiments and the appended claims, the singular forms "a," "an," and "the" are intended to include the plural forms as well, unless the context clearly indicates otherwise. It will also be understood that, although the terms first, second, etc. are, in some instances, used herein to describe various elements, these elements should not be limited by these terms. These terms are only used to distinguish one element from another.

Figure 1:
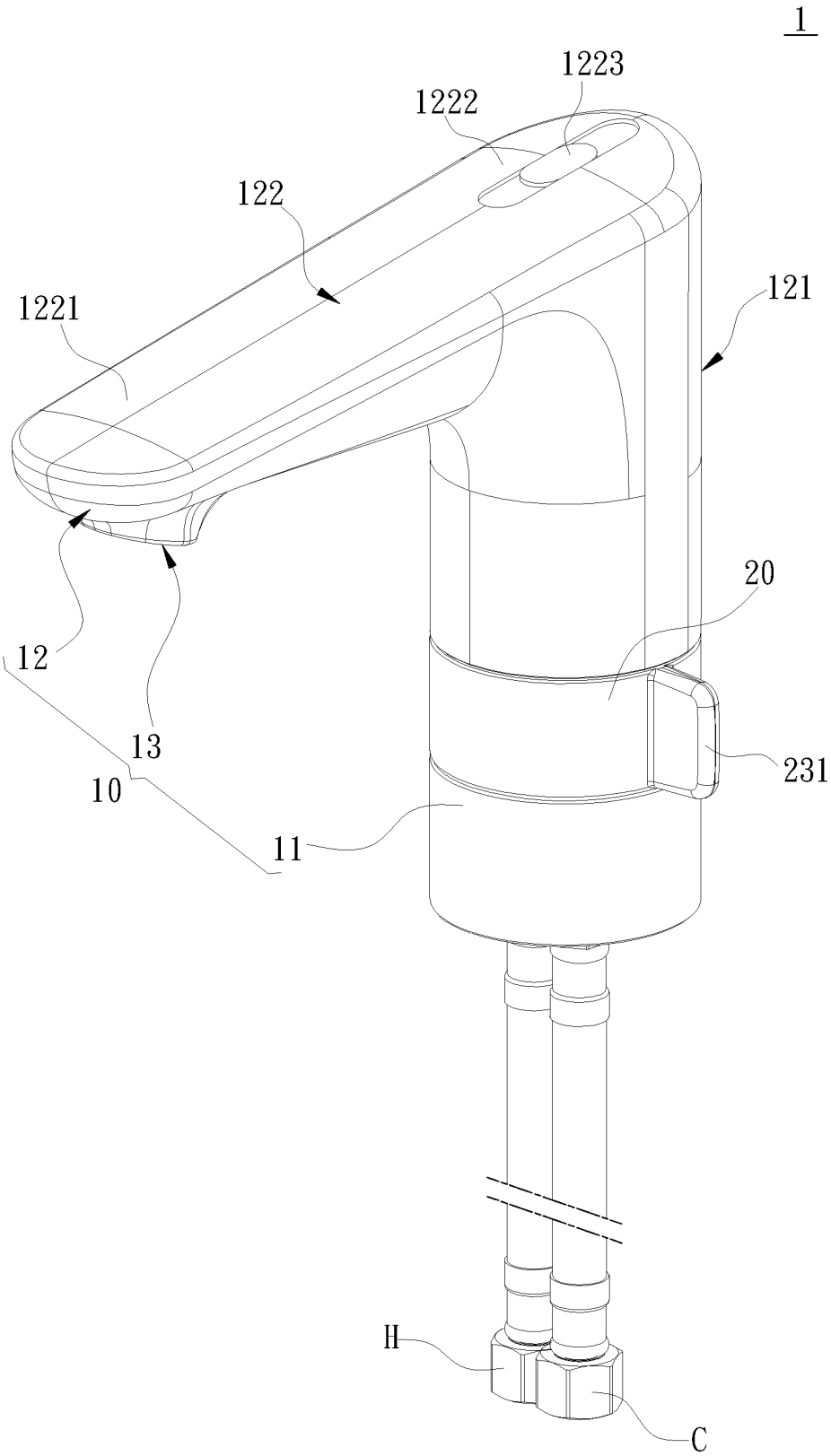
FIG. 1 is a perspective assembly view according to one embodiment of the invention.
Figure 2:
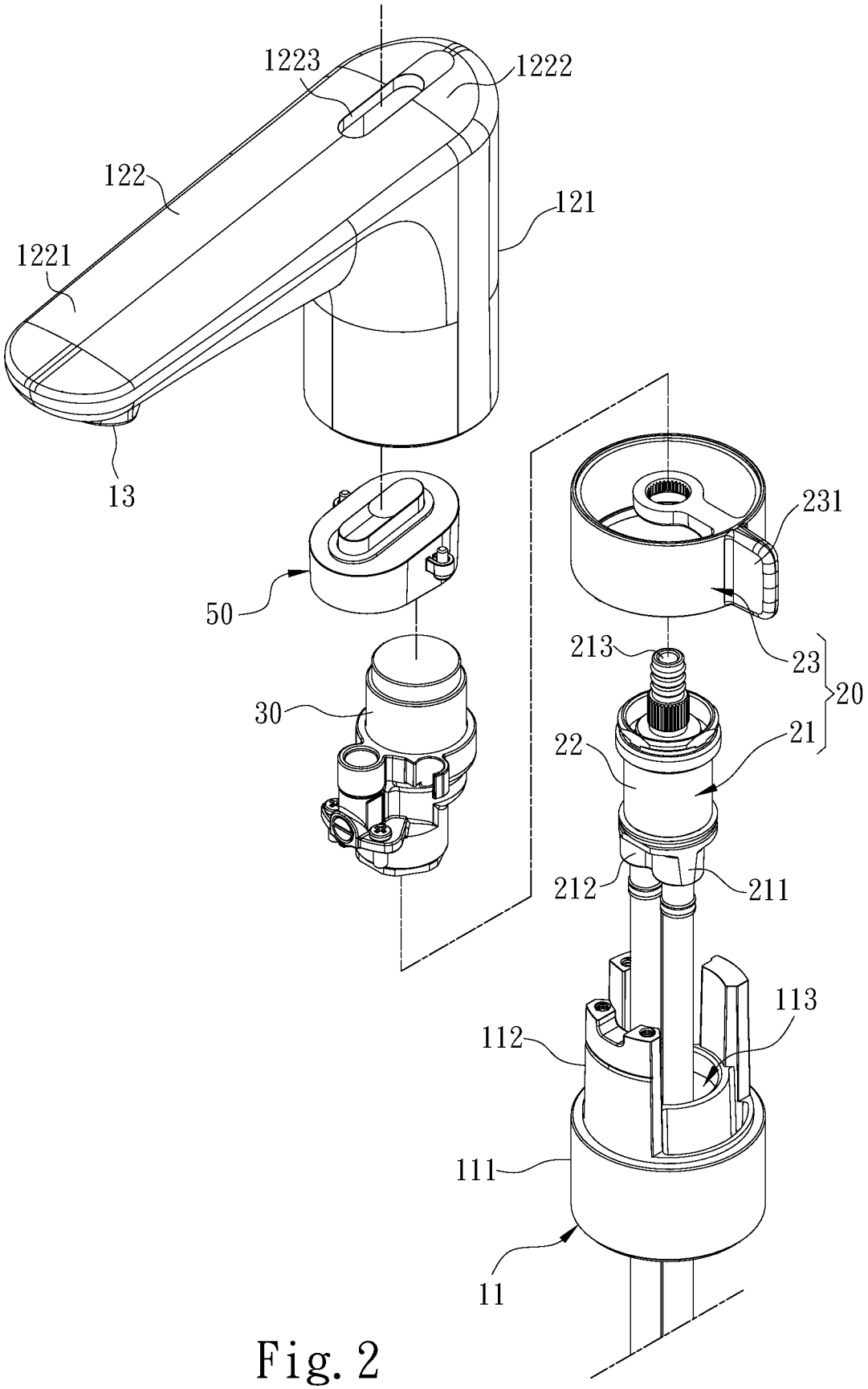
FIG. 2 is an exploded view according to one embodiment of the invention.
Figure 3:
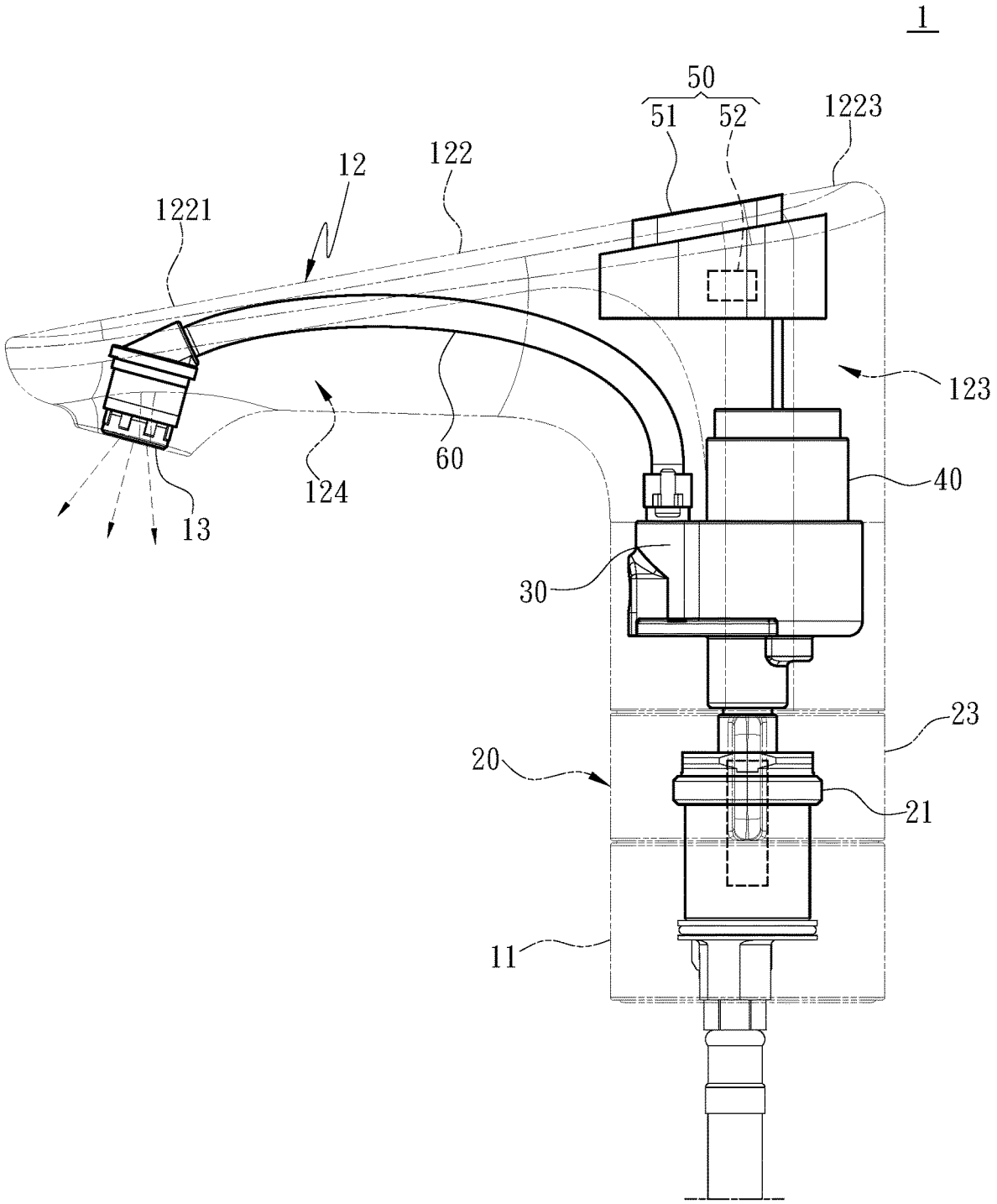
FIG. 3 is a schematic diagram according to one embodiment of the invention.

Referring to FIG. 1, FIG. 2, and FIG. 3, a near-end sensing electronic faucet 1 comprises a water outlet faucet 10, a manual mixing valve 20, a water way assembly 30, an electronic switch valve 40, and an electronic module 50. The manual mixing valve 20 is capable of controlling a temperature of an outlet water. The electronic module 50 is capable of detecting a presence of nearby objects (for example, the user's hand), thereby determining on and off of the electronic switch valve 40 to control the outlet water, and greatly improving the convenience of use. The electronic switch valve 40 and the electronic module 50 can be connected to an external electric power to provide electric power required by the electronic switch valve 40 and the electronic module 50. The external electric power can be a battery pack or an AC power supply (e.g. domestic power). In one example, the water outlet faucet 10 and the water way assembly 30 are made of zinc metal (pure metal or alloy), which provides the advantages of light weight, high processability and low cost.

The water outlet faucet 10 comprises a base 11, an extending portion 12, and a spout 13. The base 11 comprises a periphery 111, at least one protrusion 112, and a hollow 113. The extending portion 12 comprises an upright mounting section 121, an extending section 122, a first space 123, and a second space 124, the extending portion 12 is mounted on the protrusion 112, the extending section 122 extends forwardly from a top of the mounting section 121, the first space 123 is provided in the mounting section 121, and the second space 124 is provided in the extending section 122. The extending section 122 includes a first end portion 1221, a second end portion 1222, and an opening 1223. The spout 13 is provided on a bottom surface the first end portion 1221, and the opening 1223 is provided on a top surface of the second end portion 1222.

The manual mixing valve 20 comprises a valve body 21, a valve chamber 22 and a temperature adjustment part 23, and the temperature adjustment part 23 comprises a protruding adjusting lever 231. The valve body 21 is provided in the hollow 113 of the base 11, the valve chamber 22 is received in the valve body 21, the adjusting lever 231 is arranged on the periphery 111 of the base 11, and the adjusting lever 231 is coupled to the valve body 21. The valve body 21 comprises a first lower inlet 211, a second lower inlet 212, and an upper outlet 213. The first lower inlet 211 and the second lower inlet 212 are respectively fluidly connected to a cold water source C and a hot water source H, and a mixed water is output from the upper outlet 213. The temperature adjustment part 23 is capable of adjusting flow of the cold water source C and the hot water source H entering the valve chamber 22 to change a water temperature of the mixed water. The electronic switch valve 40 is driven by the electronic module 50 to switch between an on state and an off state. In the on state, the electronic switch valve 40 allows the mixed water to flow out of the water way assembly 30. While in the off state, the electronic switch valve 40 prevents the mixed water from flowing out of the water way assembly 30.

Figure 4:
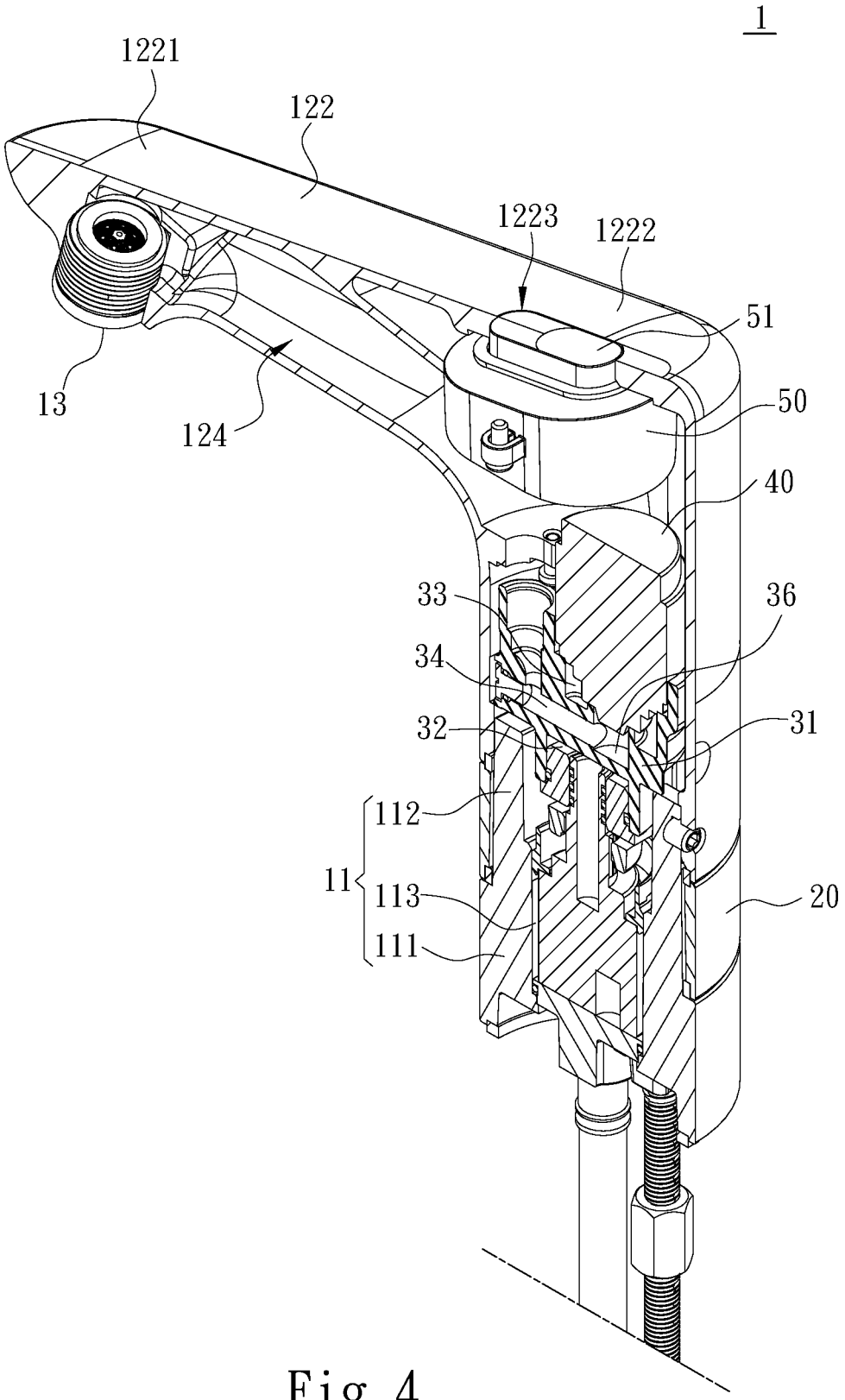
FIG. 4 is a perspective cross-sectional view according to one embodiment of the invention.
Figure 5:
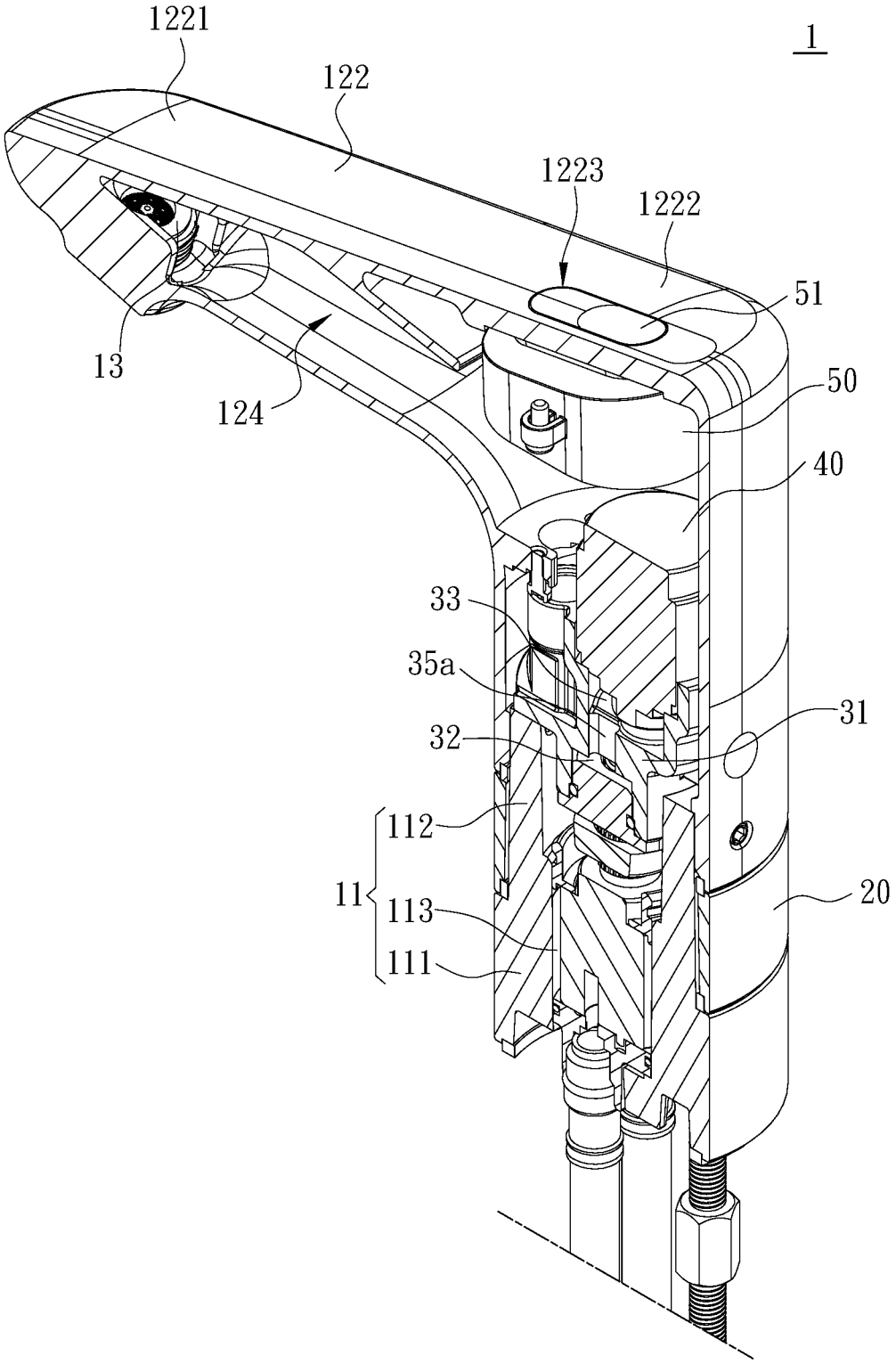
FIG. 5 is a perspective cross-sectional view according to one embodiment of the invention.
Figure 6:
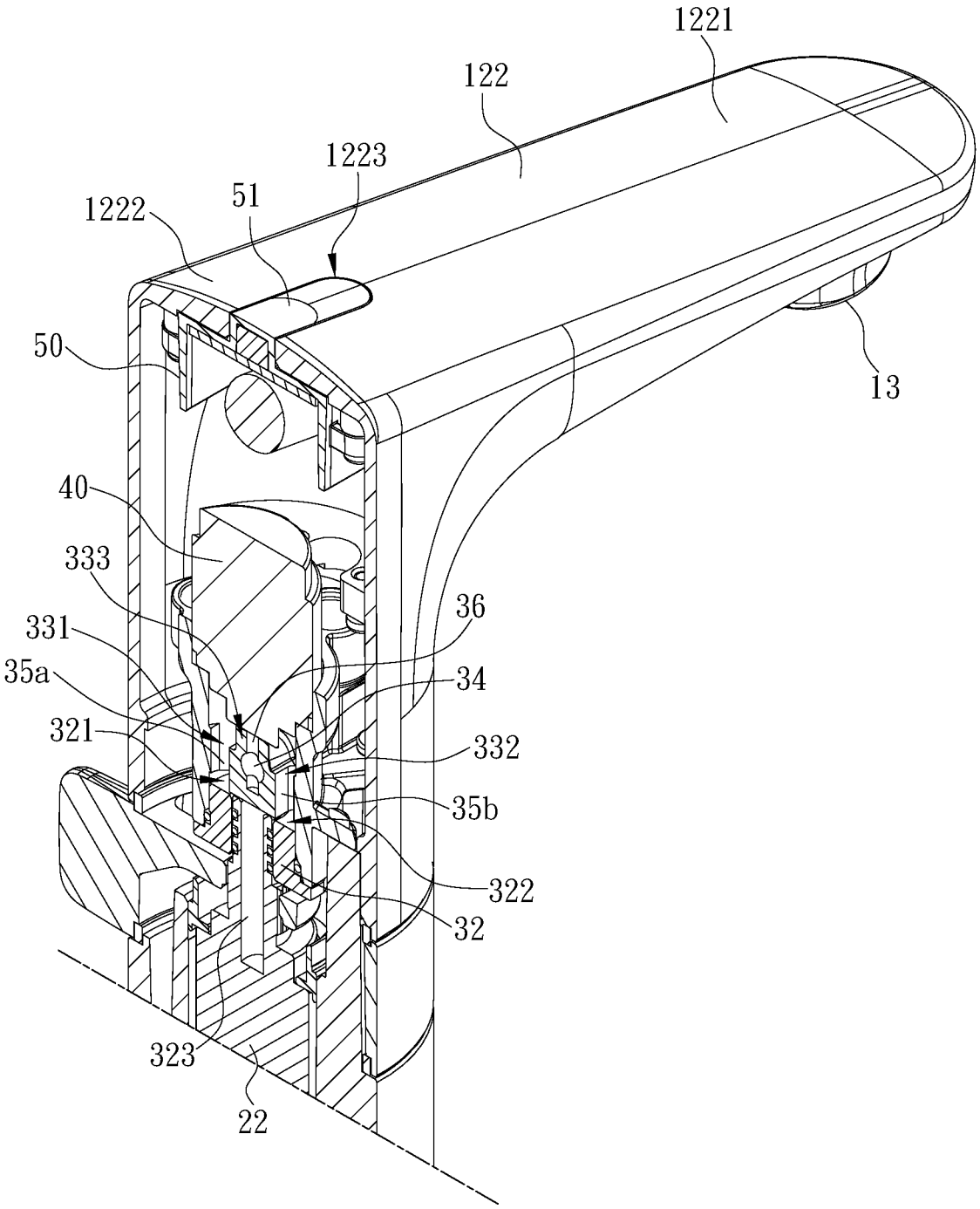
FIG. 6 is a perspective cross-sectional view of one embodiment of the invention being viewed from another angle.

Referring to FIG. 4, FIG. 5, and FIG. 6, the water way assembly 30 is received in the first space 123 and provided on the manual mixing valve 20. The water way assembly 30 comprises a body 31, a first annular chamber 32, a second annular chamber 33, a transverse fluid channel 34, at least one first upright fluid channel 35*a*, 35*b*, and a second upright fluid channel 36. The first annular chamber 32, the second annular chamber 33, the transverse fluid channel 34, the first upright fluid channels 35*a*, 35*b*, and the second upright fluid channel 36 are formed in the body 31. The first annular chamber 32 of the water way assembly 30 communicates with the upper outlet 213 of the valve body 21 of the manual mixing valve 20 via a fluid channel 37, and the second annular chamber 33 is arranged above the first annular chamber 32. The first annular chamber 32 comprises a first upper opening 321, a second upper opening 322, and a lower opening 323. The first annular chamber 32 is formed in a disc shape. The first upper opening 321 and the second upper opening 322 are respectively located at two sides of the first annular chamber 32, and the lower opening 323 is located at a center of the first annular chamber 32. The second annular chamber 33 comprises a first lower opening 331, a second lower opening 332, and a third lower opening 333. The second annular chamber 33 also formed in a disc shape. The first lower opening 331 and the second lower opening 332 are respectively located at two sides of the second annular chamber 33, and the third lower opening 333 is provided at a center of the second annular chamber 33.

Two ends of the first upright fluid channel 35*a* are communicated between the first upper opening 321 of the first annular chamber 32 and the first lower opening 331 of the second annular chamber 33; and two ends of the first upright fluid channel 35*b* are communicated between the second upper opening 322 of the first annular chamber 32 and the second lower opening 332 of the second annular chamber 33, thereby the first annular chamber 32 and the second annular chamber 33 are communicated with each other. The transverse fluid channel 34 is provided in a space between the first annular chamber 32 and the second annular chamber 33, and is provided between the first upright fluid channels 35*a*, 35*b*. The transverse fluid channel 34 comprises a first port 341 and a second port 342, and two ends of the second upright fluid channel 36 are communicated between the third lower opening 333 of the second annular chamber 33 and the first port 341 of the transverse fluid channel 34. The second port 342 of the transverse fluid channel 34 is communicated with the spout 13 via a hose 60, as shown in FIG. 3.

The electronic switch valve 40 and the electronic module 50 are provided in the first space 123 of the mounting section 121 and are provided above the water way assembly 30. The electronic switch valve 40 comprises a valve body and a sealing member 41. The sealing member 41 is provided between the third lower opening 333 of the second annular chamber 33 and the second upright fluid channel 36. The electronic module 50 is electronically coupled to the electronic switch valve 40 to control movement of the sealing member 41 of the electronic switch valve 40, such that the sealing member 41 is able to be moved between a release position and a retention position. As shown in the figures, the second annular chamber 33 can be treated as a valve seat.

The electronic module 50 comprises a proximity sensor 51 and a power element 52. As shown in FIG. 1, the proximity sensor 51 is exposed on a top surface of the extending section 122 (above the mounting section 121) of the water outlet faucet 10. The power element 52 can be a capacitor to provide emergency power or redundant power for the electronic module 50 especially when there is a power outage, for example, turning the electronic switch valve 40 off to avoid water overflow. The proximity sensor 51 includes an activated state and an inactivated state, and the proximity sensor 51 controls on and off of the electronic switch valve 40 according to the state. The proximity sensor 51 is a touchless sensor that is capable of detecting a presence of nearby objects (for example, a user who wants to use the near-end sensing electronic faucet 1). When the proximity sensor 51 is not triggered by nearby objects, the proximity sensor 51 is in the inactivated state and the electronic switch valve 40 stays in the off state, thereby stopping the mixed water from flowing. When the proximity sensor 51 detects that the presence of nearby objects, the proximity sensor 51 is in the activated state. The proximity sensor 51 controls the electronic switch valve 40 to be in the on state, thereby allowing the mixed water to flow through the water way assembly 30. Thereby, with the proximity sensor 51, water outlet of the near-end sensing electronic faucet 1 can be controlled based on presence of objects. The proximity sensor 51 can be an infrared sensor, for example.

In this embodiment, as shown in FIG. 2, the proximity sensor 51 is provided at the second end portion 1222, and the spout 13 is arranged at a bottom end of the first end portion 1221. Since the proximity sensor 51 is exposed on the top surface of the second end portion 1222, the user can identify the location of the proximity sensor 51 more readily and conveniently.

Figure 7A:
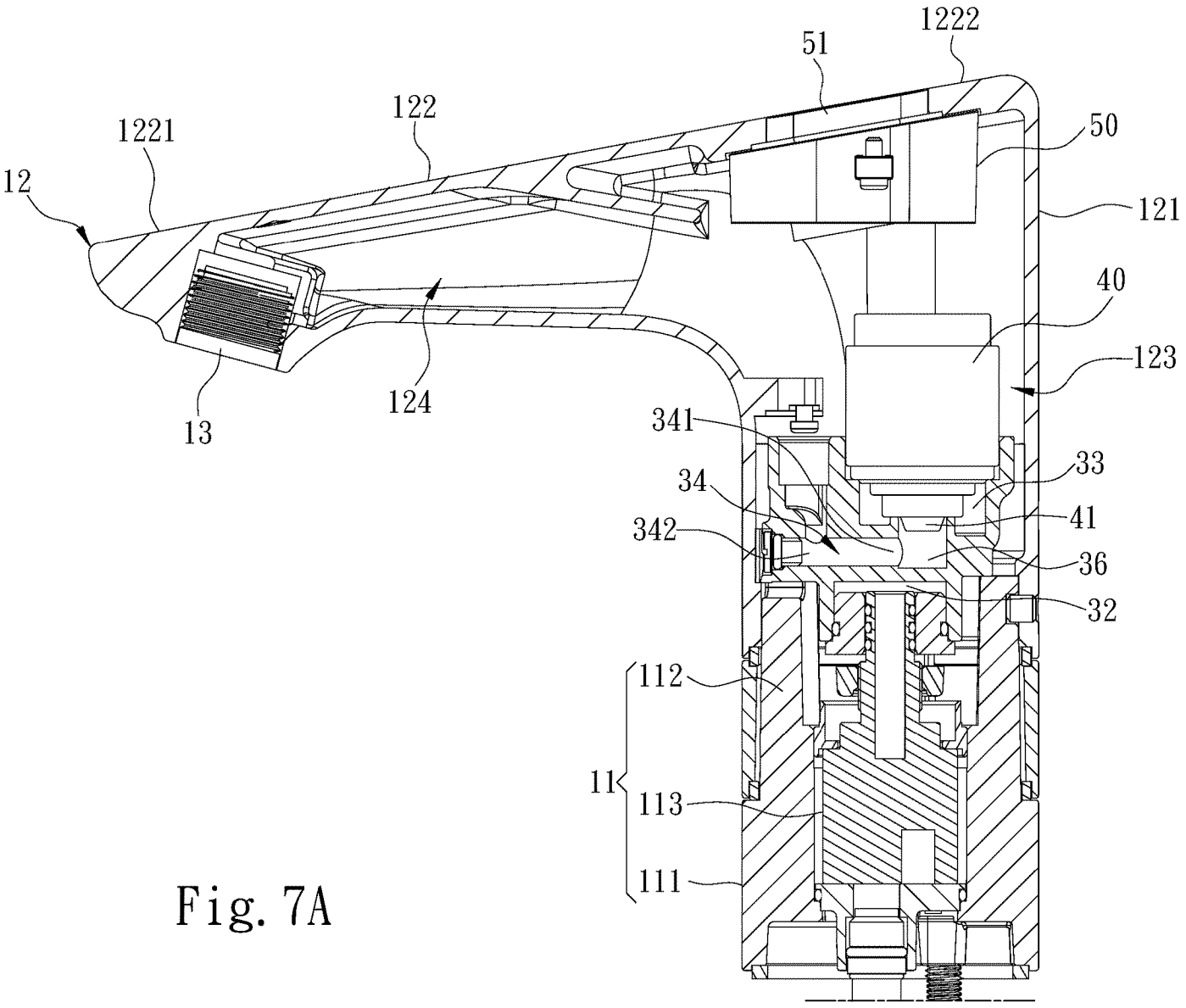
FIGS. 7A and 7B are cross-sectional views according to one embodiment of the invention.
Figure 7B:
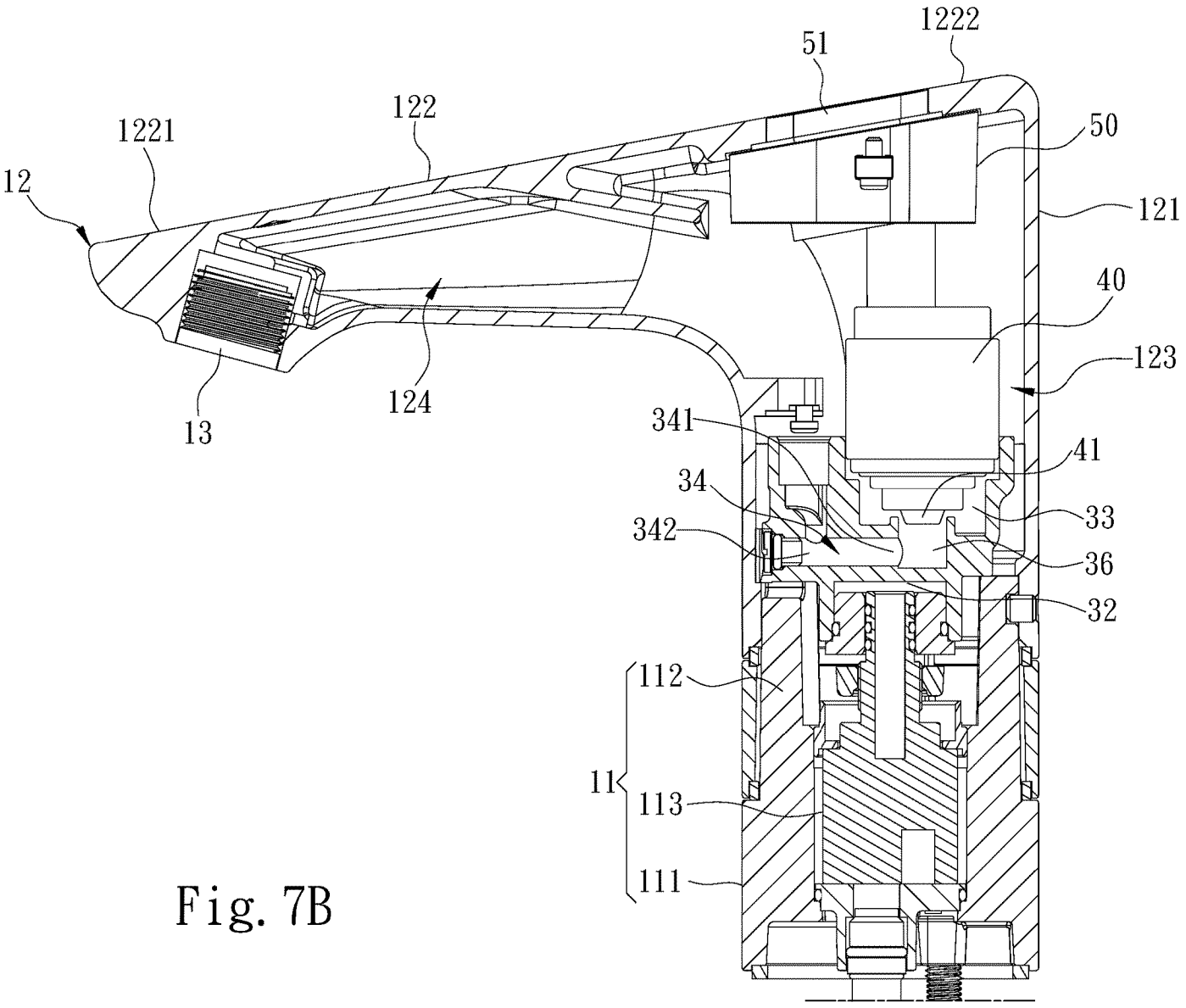

While using the electronic faucet, the user manipulates the temperature adjustment part 23 of the manual mixing valve 20 to adjust a ratio of flow of the cold water source C and the hot water source H entering the valve chamber 22 to change the water temperature of the mixed water. In this embodiment, the user manipulates the adjusting lever 231 to left or right to adjust the water temperature; and the user activates the electronic switch valve 40 by approaching the proximity sensor 51 or shut off the electronic switch valve 40 by moving away from the proximity sensor 51, thereby controlling whether the mixed water enters the second upright fluid channel 36 from the second annular chamber 33. The sealing member 41 of the electronic switch valve 40 is normally in the retention position (as shown in FIG. 7A), when the user or an object approaches the proximity sensor 51 to activate the electronic switch valve 40, the sealing member 41 of the electronic switch valve 40 moves upwardly from the retention position to the release position (as shown in FIG. 7B) to cause the second annular chamber 33 to communicate with the second upright fluid channel 36 for the mixed water to pass through the transverse fluid channel 34 and the fluid channel 37 and then flow out from the spout 13.

The configuration of the first annular chamber 32, the second annular chamber 33, the transverse fluid channel 34, the first upright fluid channels 35*a*, 35*b*, and the second upright fluid channel 36 constitutes of a vertical reverse pathway for water flow. The mixed water flows upwardly (from the first annular chamber 32 through the first upright fluid channels 35*a*, 35*b*) and then flows inwardly and downwardly (from the second annular chamber 33 to the transverse fluid channel 34 through the second upright fluid channel 36) to the spout 13 via the hose 60, instead of directly to the spout 13 as in a conventional faucet. In this way, the water way assembly 30 has a function of moderating the water flow, so that the mixed water is pouring in a gentle way for use to prevent water pressure from being too strong.

Furthermore, the near-end sensing electronic faucet provided by the embodiment of the invention is capable of easily adjusting a temperature of the outlet water through the manual mixing valve. Through the electronic module and the electronic switch valve, water outlet of the near-end sensing electronic faucet can be effectively and accurately controlled, which greatly improves the convenience of installation and use of the near-end sensing electronic faucet, reduces installation procedures, and reduces costs.

What is claimed is:

1. A near-end sensing electronic faucet comprising:

a water outlet faucet comprising a mounting section extending along an upright axis and an extending section extending forward from a top of the mounting section, the mounting section comprising a first space and a bottom opening communicating with the first space, the extending section comprising a second space communicating with the first space, and a spout;

a manual mixing valve received in the first space of the mounting section, and comprising a valve body, a valve chamber received in the valve body, and a adjusting lever coupled to the valve body, the valve chamber comprising a first lower inlet connected to a cold water source, a second lower inlet connected to a hot water source, and an upper outlet outputting a mixed water, the adjusting lever being manipulated to adjust flow of the cold water source and the hot water source entering the valve chamber to change a water temperature of the mixed water;

a water way assembly received in the first space of the mounting section and provided on the manual mixing valve, the water way assembly comprising a first annular chamber communicating with the upper outlet, a second annular chamber provided above the first annular chamber and communicating with the first annular chamber, a transverse fluid channel provided between the first annular chamber and the second annular chamber, at least one first upright fluid channel communicating between the first annular chamber and the second annular chamber, and a second upright fluid channel communicating between the second annular chamber and the transverse fluid channel, the transverse fluid channel including an opening away from the second upright fluid channel, the opening communicating with the spout;

an electronic switch valve received in the first space of the mounting section and provided above the water way assembly, the electronic switch valve comprising a sealing member provided between the second annular chamber and the second upright fluid channel, the sealing member being movable between a release position and a retention position; and an electronic module comprising a proximity sensor and a controller, the controller being received in the second space of the extending section and electrically connected to the proximity sensor, the proximity sensor being provided and partially exposed on a top surface of the extending section to detect a presence of a nearby object such that the controller controls the electronic switch valve according to detection of the proximity sensor.

2. The near-end sensing electronic faucet as claimed in claim 1, wherein the upper outlet and the first annular chamber are configured to be coaxial with each other along a first axial direction, the second annular chamber and the second upright fluid channel are configured to be coaxial with each other along a second axial direction, and the first upright fluid channel is provided on at least one side of the transverse fluid channel.

3. The near-end sensing electronic faucet as claimed in claim 2, wherein the first axial direction and the second axial direction are relatively spaced apart from each other by an interval.

4. The near-end sensing electronic faucet as claimed in claim 1, wherein a minimum outer diameter of the second annular chamber is greater than a maximum outer diameter of the second upright fluid channel for the mixed water to flow into the second upright fluid channel from the second annular chamber inwardly and downwardly.

5. The near-end sensing electronic faucet as claimed in claim 1, wherein the top surface includes a first end portion, a second end portion, and a middle portion, the middle portion is provided between the first end portion and the second end portion, the proximity sensor is provided at the second end portion, and the spout is provided below the first end portion.

6. The near-end sensing electronic faucet as claimed in claim 1, wherein a hose is connected between the opening and the spout.

7. The near-end sensing electronic faucet as claimed in claim 1, wherein further comprising a power element, the power element being coupled to the electronic switch valve and the electronic module, and the power element providing electric power required for operation of the electronic switch valve and the electronic module.

8. The near-end sensing electronic faucet as claimed in claim 1, wherein the water outlet faucet is made of zinc metal.

9. The near-end sensing electronic faucet as claimed in claim 1, wherein the water way assembly is made of zinc metal.

* * * * *